US005476124A

United States Patent [19]

Lisec

[11] Patent Number: 5,476,124

[45] Date of Patent: Dec. 19, 1995

[54] PROCESS AND APPARATUS FOR FILLING INSULATING GLASS PANES WITH A GAS OTHER THAN AIR

[76] Inventor: Peter Lisec, Bahnhofstrasse 34, A-3363 Amstetten-Hausmening, Austria

[21] Appl. No.: 343,900

[22] Filed: Nov. 17, 1994

Related U.S. Application Data

[62] Division of Ser. No. 145,504, Nov. 4, 1993, Pat. No. 5,413,156.

[30] Foreign Application Priority Data

Dec. 18, 1992 [AT] Austria ..... 2519/92
Feb. 25, 1993 [DE] Germany ..... 9302744 U

[51] Int. Cl.[6] ..... B65B 43/42; B67C 3/00

[52] U.S. Cl. ..... 141/4; 141/66; 141/165; 141/369; 156/99; 156/102

[58] Field of Search ..... 141/4, 7, 59, 65, 141/66, 129, 370, 369, 165; 156/99, 107, 104, 102, 101

[56] References Cited

U.S. PATENT DOCUMENTS

| | | | |
|---|---|---|---|
| 4,369,084 | 1/1983 | Lisec | 156/382 |
| 4,406,726 | 9/1983 | Lisec . | |
| 4,434,024 | 2/1984 | Lisec . | |
| 4,886,095 | 12/1989 | Lisec | 141/4 |
| 5,110,337 | 5/1992 | Lisec | 141/4 |
| 5,350,469 | 9/1994 | Lenhardt et al. | 156/102 |
| 5,366,574 | 11/1994 | Lenhardt et al. | 156/102 |
| 5,413,156 | 5/1995 | Lisec | 141/165 |

FOREIGN PATENT DOCUMENTS

| | | |
|---|---|---|
| 368985 | 11/1982 | Austria . |
| 370201 | 3/1983 | Austria . |
| 370706 | 4/1983 | Austria . |
| 2956/87 | 11/1987 | Austria . |
| 385499 | 4/1988 | Austria . |
| 393827 | 12/1991 | Austria . |
| 0444391 | 9/1991 | European Pat. Off. . |
| 3101342 | 7/1982 | Germany . |
| 3402323 | 8/1985 | Germany . |
| 4100697 | 8/1991 | Germany . |
| 4202612 | 8/1992 | Germany . |

*Primary Examiner*—J. Casimer Jacyna
*Assistant Examiner*—Steven O. Douglas
*Attorney, Agent, or Firm*—Young & Thompson

[57] ABSTRACT

A process and apparatus for filling insulating glass panes (10) with filler gas comprises two plates (1 and 2) and an endless conveyor belt (9) provided at the lower rim of the plates (1 and 2), on which the insulating glass pane (10) stands with its lower, open edge. Sealing devices (30 and 31) that can be brought into contact with the vertical edges of the insulating glass pane (10) are provided between the plates (1 and 2) in order to seal the interior of the insulating glass pane (10). The sealing device (30)is associated with a connection (50) for feeding filler gas into the interior of the insulating glass pane (10). Air and air-gas mixtures can be removed from the insulating glass pane (10) via a channel formed between the other vertical edge of the insulating glass pane (10) and a sealing device (31) applied at that location, whereby air or air-gas mixture can flow out over the entire height of the open, vertical rim of the insulating glass pane (10) from the interior of the latter.

3 Claims, 5 Drawing Sheets

PROCESS AND APPARATUS FOR FILLING INSULATING GLASS PANES WITH A GAS OTHER THAN AIR

This application is a division of application Ser. No. 08/145,504, now U. S. Pat. No. 5,413,156 filed Nov. 4, 1993.

FIELD OF THE INVENTION

The invention relates to a process for filling insulating glass panes with a filler gas wherein the insulating glass pane is arranged standing in a substantially perpendicular position, and one of the glass sheets of the insulating glass pane is in contact with the spacer frame attached to the other glass sheet essentially only with its upper, horizontal marginal zone, and wherein the lower, horizontal rim of this glass sheet is located at a distance from the spacer frame.

The invention furthermore concerns an apparatus for filling insulating glass panes not as yet bonded by pressing with a filler gas, with two substantially perpendicularly aligned plates arranged on both sides of the insulating glass pane to be filled, for example the plates of a device for press-bonding insulating glass panes, at least one of these plates being displaceable transversely to its plane relatively to the other plate, and with a conveyor for the insulating glass panes in the zone of the lower rim of the plates.

BACKGROUND OF THE INVENTION

For filling insulating glass panes with a gas (filler gas) different from air, such as sulphur hexafluoride or a noble gas, particularly argon, it has been suggested to provide access to the interior of an insulating glass pane by maintaining, during the assembly of the insulating glass pane, the second glass sheet over a portion of its periphery at a distance from the spacer frame attached to the first glass sheet (Austrian Patent 368,985). In this operating technique, the filler gas is introduced into the interior of the insulating glass pane through the gap-shaped interspace formed between the second glass sheet arranged at a spacing from the spacer frame and the spacer frame attached to the other, first glass sheet.

The device known from Austrian Patent 368,985 has the drawback that it is not only necessary to flood the interior of the insulating glass pane with filler gas but also to flood the space between the two plates of the device wherein the process is carried out with a filler gas so that considerable amounts of gas are needed and not inconsiderable gas losses can occur.

OBJECT OF THE INVENTION

The invention is based on the object of proposing, starting with Austrian Patent 368,985, a process and apparatus wherein gas losses during gas exchange can be most extensively avoided and wherein filler gas flows substantially only into the inner space of the insulating glass pane, and the space between the two plates is not flooded with filler gas.

SUMMARY OF THE INVENTION

This object is attained by providing that the lower, horizontal open rim of the insulating glass pane and the two at least partially open, vertical rims of the insulating glass pane are sealed off, that filler gas is introduced into the interior of the insulating glass pane in the zone of the one vertical rim, and that air or, respectively, air-gas mixture is exhausted via the oppositely disposed, open, vertical rim of the insulating glass pane.

Additional features, details and advantages of the apparatus of this invention can be seen from the following description and the embodiments of the invention schematically illustrated in the drawings wherein:

BRIEF DESCRIPTION OF THE INVENTION

FIG. 1 shows a first embodiment of the apparatus in a lateral view,

FIG. 2 shows, likewise in a lateral view, a second embodiment of the apparatus, FIG. 3 shows an apparatus in a frontal view without the front plate, FIG. 4 shows a horizontal section through the apparatus of FIG. 3 in the zone of the insulating glass pane disposed therein, FIG. 5 shows another embodiment in a sectional view analogous to FIG. 4, FIG. 6 shows, in a top view, an example for a connection for the feeding of filler gas, and FIG. 7 shows, in an end view, an example for a sealing device.

DETAILED DESCRIPTION OF THE INVENTION

Figure 1:
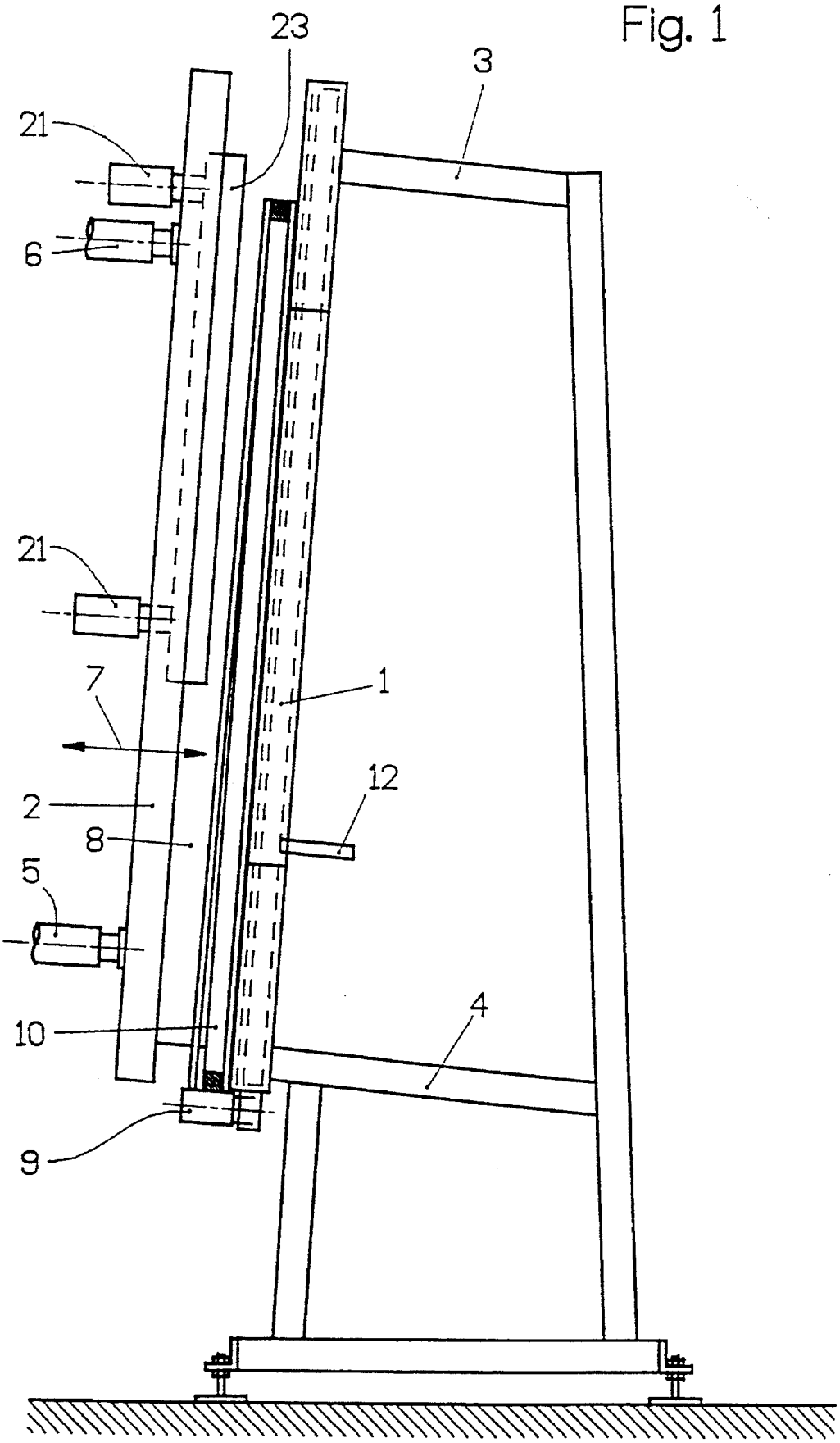

The apparatus illustrated in FIG. 1 comprises two mutually parallel plates 1 and 2 which are substantially perpendicular and are preferably slightly inclined toward the rear with respect to the vertical, for example by 3–5°.

The plates 1 and 2 can be the plates of a device for bonding insulating glass panes 10 under pressure. In the illustrated embodiment, the plate 1 is fixedly attached to supports 3 and 4 of the frame of the apparatus. The plate 2 is movable in the direction of double arrow 7 by way of pressure medium cylinders 5 and 6. At the lower rim of the fixed plate 1, below the space 8 located between the plates 1 and 2, a conveyor belt 9 is provided; an insulating glass element 10 can be transported into the space 8 while standing on this conveyor belt and leaning against the plate 1 affixed to the frame, this plate being designed, for example, as an air cushion wall. It can be seen from FIG. 1 that the glass sheet of the insulating glass pane 10 facing the movable plate 2 is in contact with the spacer frame attached to the other glass sheet merely in the upper zone whereas the lower horizontal rim of this glass sheet of the insulating glass pane 10 has a distance from the spacer frame.

In order to activate the fixed plate 1, which is designed as an air cushion wall, this plate is equipped with a connection 12 for the feeding of compressed air thereto.

Figure 2:
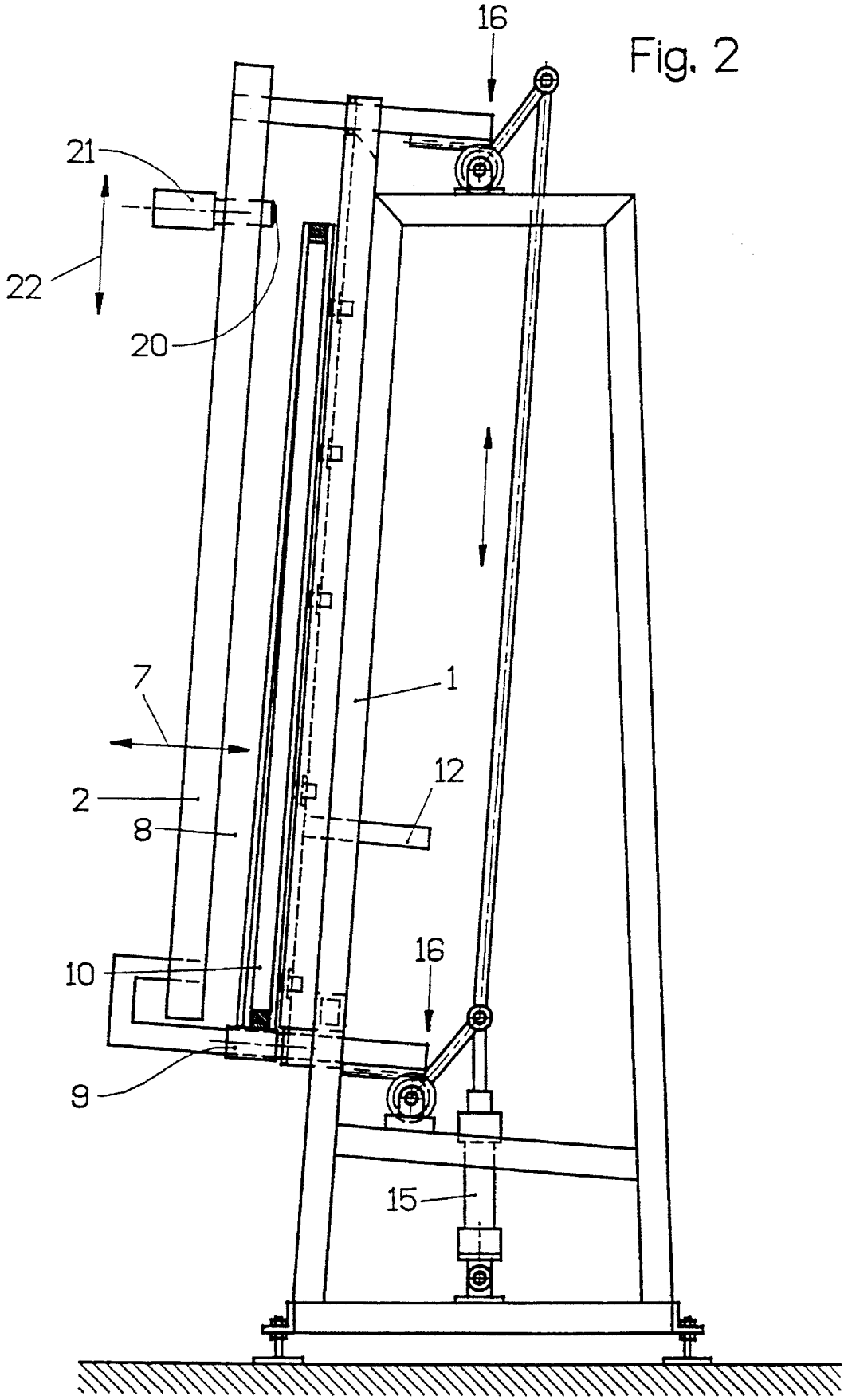

The embodiment of the apparatus shown in FIG. 2 differs from the apparatus illustrated in FIG. 1 by the feature that the movable plate 2 is adjustable in the direction of double arrow 7 with the aid of rack-and-pinion drives 16. In this embodiment, respectively one rack is provided at the four corners of the movable plate 2. The rack-and-pinion drives 16 are operated by a joint pressure medium motor 15 by way of a linkage.

A more detailed description of this drive usable, for example, for the adjustment of the plate 2 can be found in Austrian Patent 385,499. The movable plate 2 can also be adjustable with the aid of spindle drive mechanisms as known from AT-A 2956/87(published Jun. 15, 1990).

FIG. 2 shows that pressure pistons 20 are provided at the movable plate 2; these pistons can be advanced toward the upper rim of the insulating glass pane 10 with the aid of pressure medium cylinders 21 and maintain the glass sheet of the insulating glass pane 10 adjoining the movable plate 2 in contact with the spacer frame. In place of individual pressure pistons 20, it is also possible to provide a horizontally continuously extending pressure strip.

In order to be able to align the pressure pistons 20 or the horizontally continuous pressure strip with respect to the upper rim of the insulating glass element 10, the arrangement made up of pressure pistons 20 or pressure strip and pressure medium motors 21 is mounted to be displaceable in the direction of double arrow 22, i.e. substantially vertically, at the movable plate 2. If the vertical adjustability of the pressure elements is to be omitted, then it is also possible to provide vertically aligned pressure strips 23 which are resilient or are adjustable by means of pressure medium cylinders 21 (FIG. 1).

The pressure pistons 20 or pressure strips 23 can also be provided in the embodiment of the apparatus illustrated in FIG. 1.

The pressure pistons 20 or the pressure strips 23 can be retracted into or behind the surface of the movable plate 2 facing the fixed plate 1, particularly in case the apparatus is also utilized for press-bonding the insulating glass sheets after gas exchange has been completed.

Instead of providing pressure medium motors 21 for moving the pressure pistons 20 or pressure strip(s) 23, the aforementioned components (pressure piston or pressure strip) can also be resiliently supported against the movable plate 2 so that they can be urged back, during press-bonding of the insulating glass pane 10, into a position wherein their front face is in alignment with the surface of the movable plate 2 facing the insulating glass pane.

The interior of an insulating glass pane 10 located in the apparatus according to FIG. 1 or FIG. 2 is sealed in the upward direction by the upper leg of the spacer frame and in the downward direction, namely where the insulating glass pane 10 is still open, by the continuously extending conveyor belt 9 (or another, correspondingly gastight conveying means).

In order to seal the interior of the insulating glass pane 10 also along the approximately vertical side rims, sealing devices 30 and 31 that can be brought into contact with the vertical rims of the insulating glass pane 10 are provided in the apparatus of this invention.

Figure 5:
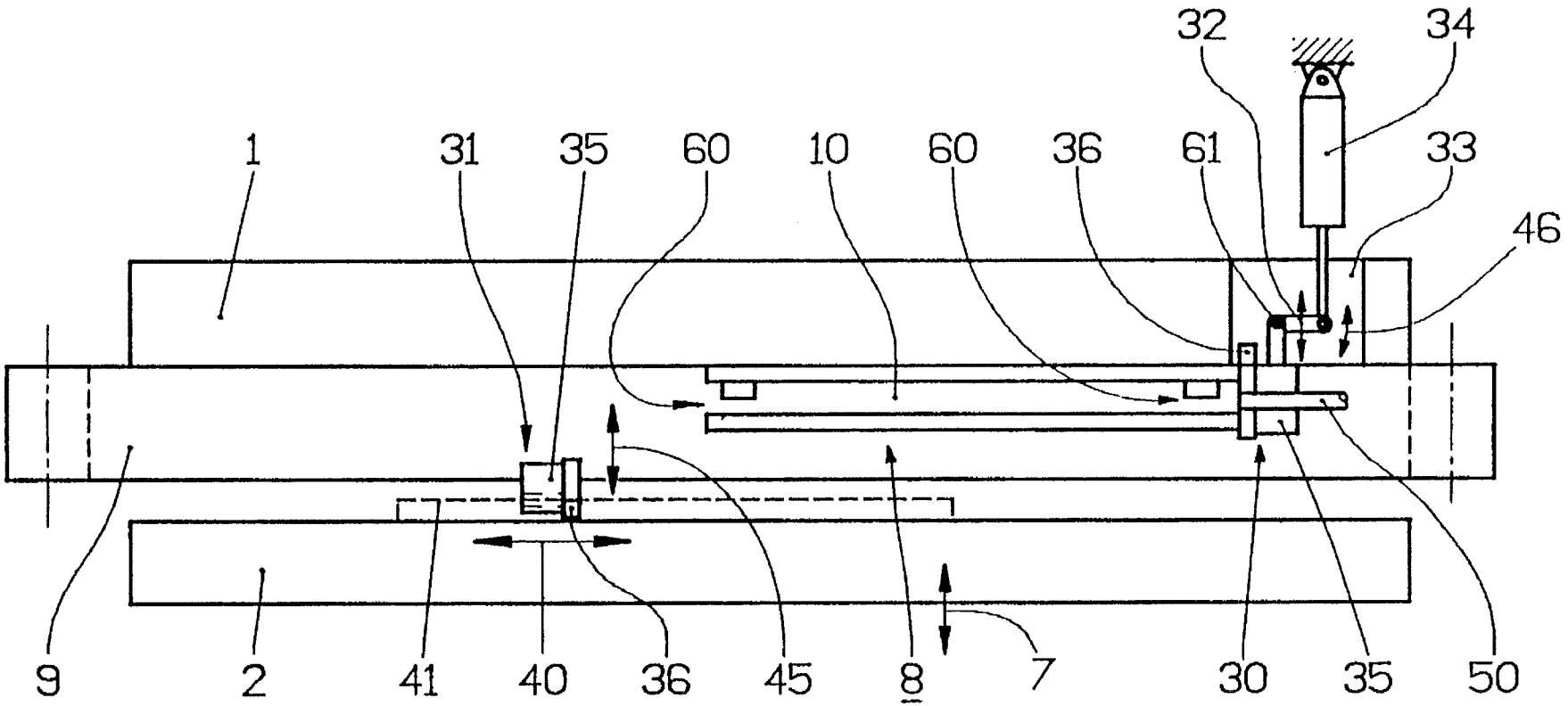

The sealing device 30 which is at the front, based on the conveying direction (arrow 25 in FIG. 3), can be advanced perpendicularly to the plane of the fixed plate 1 (double arrow 32) into the space 8 between the two plates 1 and 2, or it can be swung inwards about a substantially vertical axis 61 (see FIG. 5, arrow 46). For this purpose, a vertical slot 33 is arranged in the fixed plate 1, and the sealing device 30 is coupled with a drive mechanism, for example at least one pressure medium cylinder 34.

Figure 3:
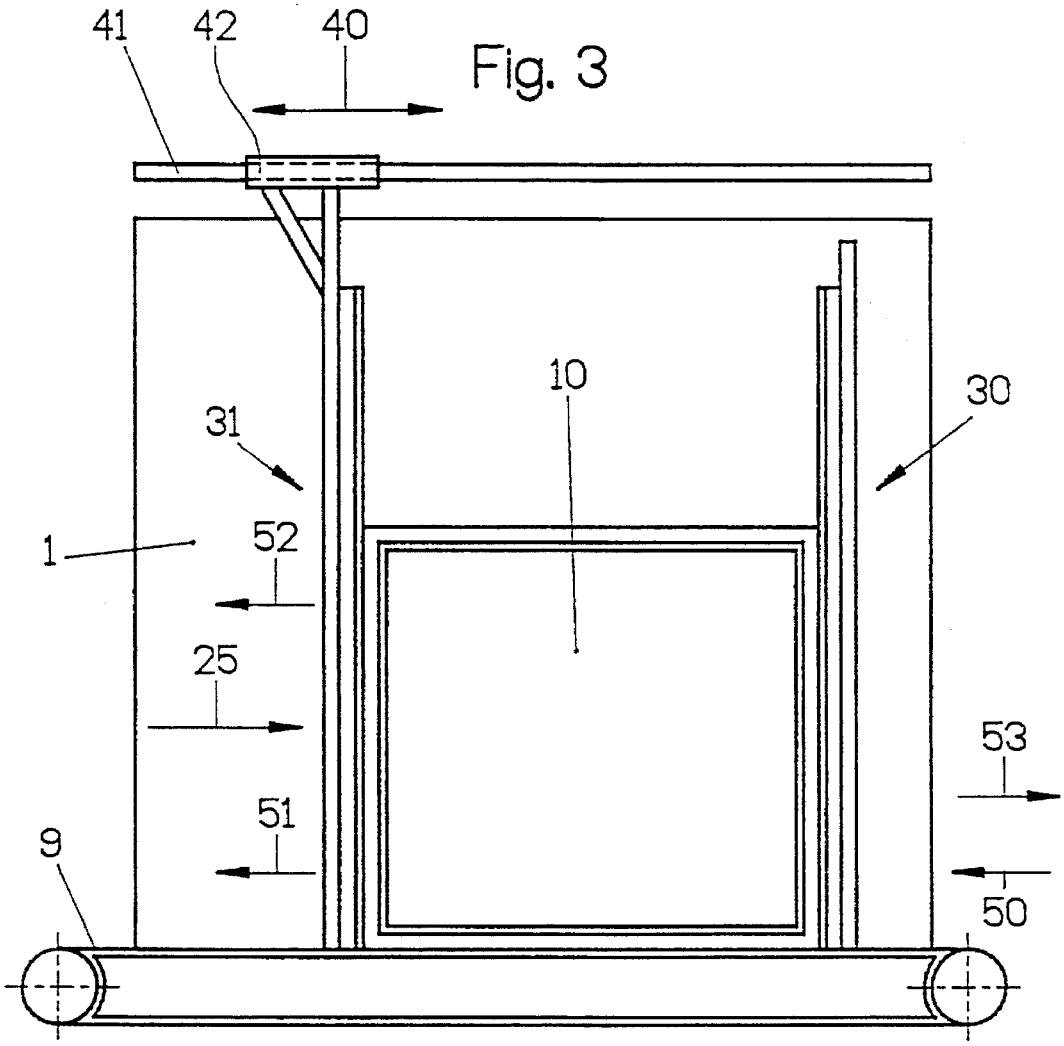
Figure 4:
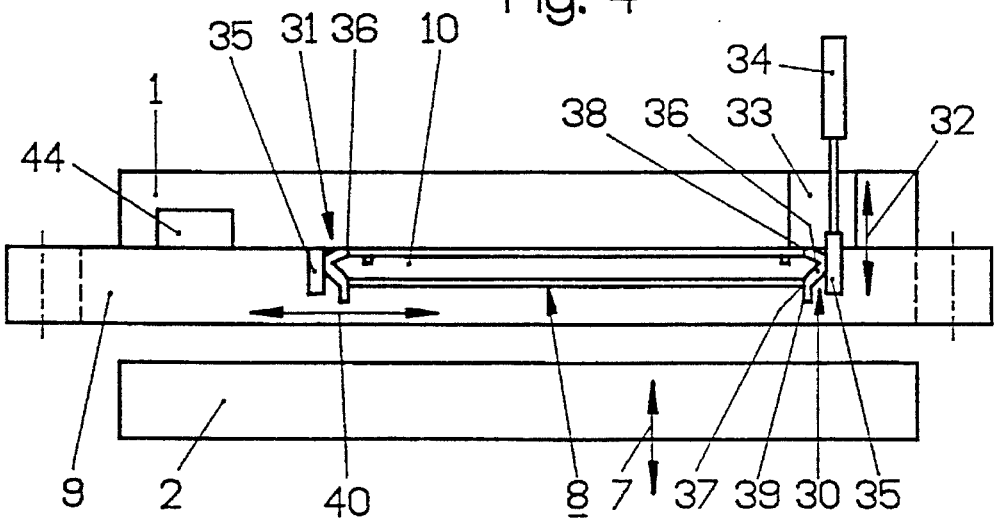

The sealing device 30 consists, in the example shown in FIGS. 3 and 4, of a substantially vertical supporting strip 35 and a gasket 36 of an elastic material. The gasket 36 is designed, in one embodiment, to be substantially of a V shape in cross section and comprises two sealing lips 37 and 38 which come into sealing contact with the vertical rims of the two glass sheets of the insulating glass pane 10.

To render the sealing device 30 usable for the insulating glass panes 10 of varying total thickness, the sealing lip 37 can carry an extension 39 oriented essentially perpendicularly to the fixed plate 1. The sealing device 30 acts simultaneously as a limitation for the feed of the insulating glass pane 10 in the direction of arrow 25 while the pane is transported into the apparatus.

The second sealing device 31 is adjustable in the apparatus in the direction of double arrow 40. For this purpose, as illustrated in FIG. 3, the provision can be made that the sealing device 31 is guided by way of a slide 42 on a guide rail 41 attached to the machine frame and is displaceable by means of a drive mechanism, not shown. Otherwise, the structure of the sealing device 31 corresponds to that of the sealing device 30, i.e. it comprises a supporting strip 35 and the gasket 36 proper with the two sealing; lips 37 and 38 and the extension 39.

In a modified embodiment, the sealing devices 30 and 31 can also be arranged at the movable plate 2.

An embodiment is likewise possible wherein the sealing; device 30 is arranged as illustrated in FIG. 4 and the sealing device 31 is mounted to the movable plate 2 (FIG. 5). In this case, the guide rail 41 is attached to the movable plate 2. For moving the sealing device 31 out of the space 8 between the plates 1 and 2 during the transporting of still open insulating glass panes 10 to be filled with filler gas into the apparatus, a recess 44 can be provided in the plate 1 in the embodiment according to FIG. 4; the sealing device 31 can be moved into this recess to vacate the space 8 between the plates 1 and 2. In case of a sealing device 31 guided on the plate 2, there is also the possibility of providing in the plate 2 a corresponding recess 44 for accommodating the sealing device 31 when the latter is in its readiness position. However, in many instances it will be sufficient to remove the movable plate 2 and thus the sealing device 31 away from the plate 1 for providing space for the feeding of an insulating glass pane 10.

A connection 50 for the supply of filler gas with which the interior of the insulating glass pane 10 is to be filled is provided at the sealing device 30. Furthermore, at least one connection 51, 52 or 53 can be included, by way of which air and/or air-gas mixture exiting from the interior of the insulating glass pane 10 is exhausted (in FIG. 3, the connections are merely symbolized by arrows). Various possibilities exist here for combining these connections 50–53.

Thus, the connection 50 for feeding filler gas can be arranged at the sealing device 30 in the zone of the forward, lower corner of the insulating glass pane 10. The connection 51, 52 or 53 for exhausting air and/or air-gas mixture can be provided at the sealing device 31 in the zone of the lower corner of the insulating glass pane 10 that is at the rear, based on the conveying direction (arrow 51), in the zone of the rearward, upper corner of the insulating glass pane 10 (arrow 52), or alternatively in the zone of the vertical edge of the insulating glass pane 10 (arrow 53) that is at the front, based on the conveying direction (arrow 25). According to an embodiment which will be described below, the connections 51–53 can also be omitted entirely, When combining connection 50 with connection 51, the connection 50 is preferably designed so that the filler gas enters the interior of the insulating glass pane 10 with an upwardly oriented flow in order to prevent filler gas from passing directly to the connection 51.

Another possibility resides in combining connection 50 with connection 52 so that a diagonal flushing of the insulating glass pane 10 results.

When combining connection 50 with connection 53, a reverse flushing of the interior of the insulating glass pane 10 takes place, as known in principle from EP-A-444,391 or DOS 4,202,612; in this case, the connection 53 can have an outlet orifice pointing upwardly in the inner space of the insulating glass pane 10.

The concrete design of the connections 50, 51, 52 and 53 for feeding filler gas into and exhausting air and air-gas mixture out of the interior of the insulating glass pane 10 is not critical. For example, it is possible to provide probes or nozzles projecting into the interior for the feeding of filler gas, in particular, or the filler gas feed conduit and the exhaust conduit for air and/or air-gas mixture are simply passed at the respective locations through the supporting strip 35 and the gasket 36 so that they terminate in the zone between the two sealing lips 37 and 38.

Figure 6:
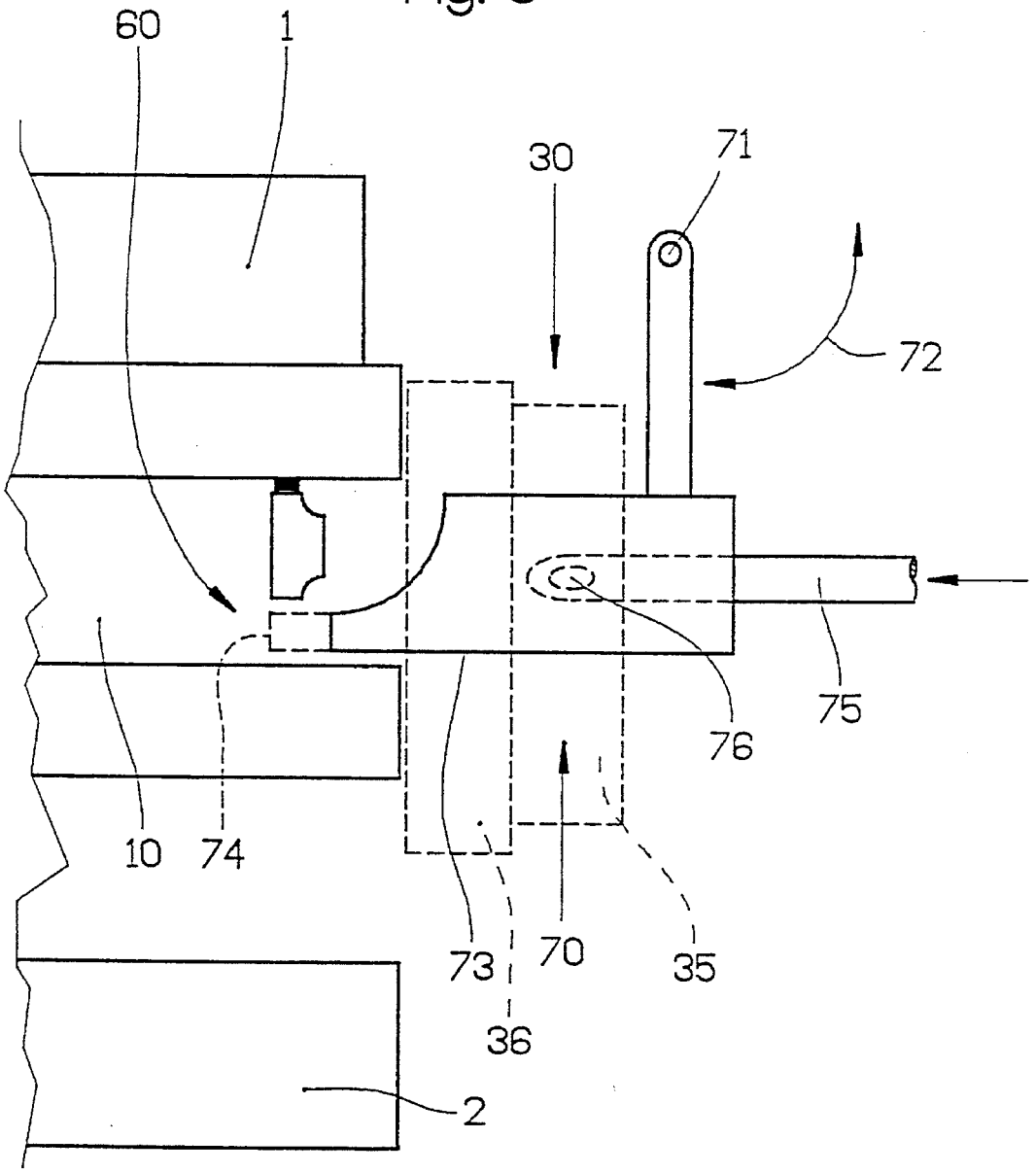

An exemplary embodiment for a connection 70 for feeding filler gas into the interior of the insulating glass pane 10 is shown in a top view in FIG. 6. The connection 70 comprises a housing 73 which can be pivoted about a substantially vertical axis 71 (arrow 72) into the operative position shown in FIG. 6 and from this position into a position swung away behind the surface of the plate 1 (or 2) facing the insulating glass pane 10. The housing 73 has an outlet opening 74 of the shape of a slotted hole which can extend up to the front of or into the gap 60 of the insulating glass pane 10. Filler gas supplied via at least one conduit 75 with a lateral orifice 76 enters from the opening 74 into the interior of the insulating glass pane 10. It is also possible to arrange several conduits 75 in superposition within the housing 73.

FIG. 6 also shows the sealing device 30 in dashed lines, the connection 70 being movable independently thereof.

Especially in case the filler gas is fed via the connection 50 and air or air-gas mixture is exhausted at location 51 and/or 53, the gaskets 36 can exhibit between their sealing lips 37 and 38 horizontally aligned webs, i.e. webs oriented perpendicularly to the plates 1 and 2, which subdivide the space ("channel") between the two sealing lips 37 and 38 and the rims of the two glass sheets of the insulating glass pane 10 in the vertical direction into at least two sections to at least impede the efflux of filler gas through the channel formed between the rims of the glass sheets of the insulating glass pane 10 and the gaskets 36. In this connection, it is also possible for the webs to have a projection in the center, this projection at least partially engaging into the space between the two glass sheets of the insulating glass pane 10. Such webs between the sealing lips 37 and 38 are provided, in particular, in the gasket 36 of the sealing device 30.

In case the connection for the feeding of filler gas is combined with the connection 53 for the exhausting of air and/or air-gas mixture, it is recommended to arrange a similar web between the two connections 50 and 53, unless the arrangement includes nozzles or probes, projecting into the interior of the insulating glass pane 10, for the feeding of filler gas and the removal of air and/or air-gas mixture.

Figure 7:
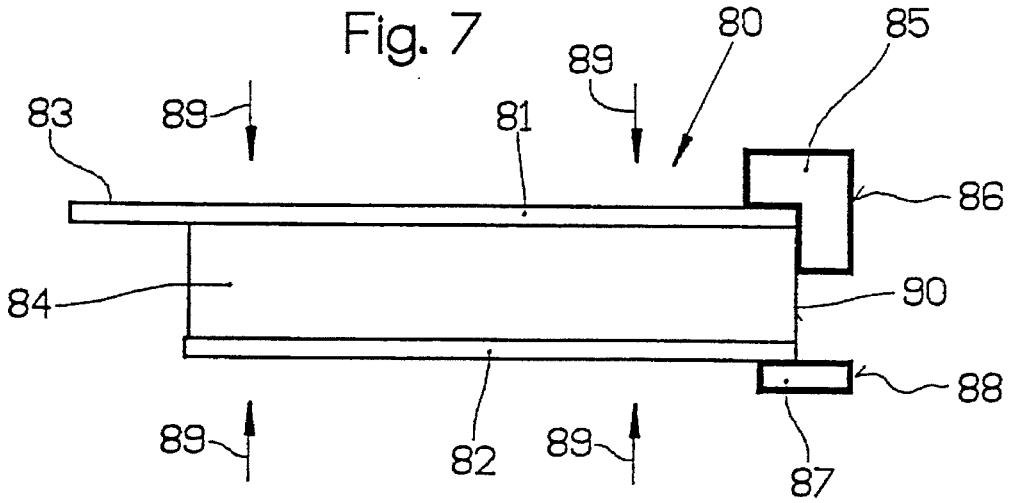

FIG. 7 illustrates a preferred embodiment of the sealing devices 30 and/or 31.

The sealing device 80, substantially of a square shape in its entirety, consists of two rectangular plates 81 and 82 made of a rigid material, for example sheet metal.

An elastically resilient square-shaped member 84, consisting, for example, of elastically compressible plastic foam material, is arranged between the plates 81 and 82 and is joined to the surfaces of the plates 81 and 82 facing this member. The member 84 can also be replaced by springs; in this arrangement, a flexible film can be provided between the plates 81 and 82, especially in the zone between the sealing strips 85 and 87.

One plate 81 projects unilaterally with its rim 83 beyond the member 84 of foam material and thus can be attached to a holding means so that the sealing device 80 can execute the movements provided for the sealing devices 30 and 31.

On the side of the sealing device 80 facing the insulating glass pane 10 to be filled with gas, sealing strips 85, 87 are provided consisting of a rubbery material, e.g. polyurethane (trade name "Vulkollan") or a similar substance. The sealing strip 85 contacts, with its surface 86, the adjoining vertical rim of one of the glass sheets of the insulating glass pane 10 whereas the sealing strip 87 contacts, with its surface 88, the vertical rim of the other glass sheet of the insulating glass pane 10. The sealing strips 85 and 87 project past the surface 90 of the sealing device 80 so that a substantially vertical channel is produced at the rim of the insulating glass pane 10 sealed with this sealing device.

When making the plates 1 and 2 of the apparatus for filling insulating glass panes 10 with filler gas approach each other, they will initially contact the outsides of the two plates 81 and 82 of the sealing device 80. These plates are made to approach each other with elastic compression of the member 84 in the direction of arrows 89 illustrated in FIG. 7 so that the sealing device 80 will not impede the further mutual approach of the plates 1 and 2 of the apparatus, for example during the closing and pressing of the insulating glass pane.

In the embodiment shown in FIG. 5, the sealing devices 30 and 31 are equipped with flat gaskets 36 (such gaskets can also be used in the embodiments of FIGS. 1-4). The sealing device 30 arranged on the side of the outlet and associated with the forward vertical rim of the insulating glass pane 10 can be swung into the space 8 between the plates 1 and 2 (axis 61, arrow 46) and is additionally adjustable perpendicularly to these plates 1 and 2 (arrow 32) in case the connection 50 for the feeding of filler gas is directly located at the sealing device for aligning this connection with respect to the gap 60 between one glass sheet and the spacer frame of the insulating glass pane.

The connection 50 can be arranged (in all embodiments) independently of the sealing device 30. Thus, the orifice of the connection 50 (FIG. 6) which is, for example, slot-shaped can be aligned with respect to the gap 60 between the spacer frame and the glass sheet located at a spacing from the latter, without having to adjust the entire sealing device 30.

Since the sealing device 31, guided at the guide means 41 to be adjustable in the direction of double arrow 40, is arranged in the embodiment shown in FIG. 5 at the movable plate 2, the insulating glass pane 10 to be filled with filler gas can be conveyed unhindered into the space 8, with the plate 2 and sealing device 31 having been moved away from the fixed plate 1. The sealing device 31 can be aligned with respect to the vertical rim of the insulating glass pane 10 by advancing the plate 2 (arrow 7) and additionally by a movement perpendicularly (arrow 45) to this plate 2, and can be brought into sealing contact with this rim.

The two sealing lips 37, 38 of the gaskets 36 of the two sealing devices 30 and 31 are so elastic, in the same way as the optionally provided webs and the extension 39 at the sealing lip 37 which can be included, that they can be elastically compressed during the press-bonding of an insulating glass pane 10 completely filled with filler gas, by making the movable plate 2 approach the plate 1, without impeding the press-bonding operation.

The apparatus according to this invention operates as follows:

An insulating glass pane 10, assembled, for example, in the apparatus known from Austrian Patent 370,201 or Austrian Patent 370,706, or by hand, one glass sheet of this pane having a spacing at the bottom from the spacer frame attached to the other glass sheet, is conveyed into the space 8 between the plates 1 and 2 while standing on the conveyor belt 9, until its vertical rim at the front as seen in the conveying direction (arrow 25) is in contact with the advanced or inwardly swung sealing device 30. At this point, the second sealing device 31 is advanced from a readiness position wherein it is located, for example, beside the plate 1 or beside the plate 2 or in a recess 44 in the plate 1 or the plate 2, within the space 8 between the two plates 1 and 2 to such an extent that its gasket 36 comes into contact, with its two sealing lips 37 and 38, with the vertical rim of the insulating glass pane 10 that is at the rear as seen in the conveying direction (arrow 25).

Once the sealing device is located at the plate 2, the plate 2 is moved toward the plate 1 in order to align the sealing device with respect to the insulating glass pane.

Thereupon, the pressure pistons 20 (or the pressure strip), insofar as present, are advanced with respect to the movable plate 2 and brought into contact with the upper rim of the insulating glass pane 10 (in case of resilient pressure pistons 20 or a resilient pressure strip, the plate 2 is made to approach the plate 1 until the pressure pistons 20 or the pressure strip come or comes into contact with the facing glass sheet). The movable plate 2 can also be advanced toward the fixed plate 1 to such an extent that the movable plate 2 contacts the adjoining glass sheet of the insulating glass pane 10 from the side at its rim resting on the conveying means 9, and thus supports the glass sheet in the region of its bottom rim.

As soon as this has occurred, the interior of the insulating glass pane 10 is sealed all around, and the actual gas exchange can commence. In this step, filler gas is introduced via the connection (arrow 50) into the interior of the insulating glass pane 10, and air or, respectively, air-gas mixture is withdrawn, for example via the discharge conduits 51, 52 and/or 53; in this operation, the exhausting of air or air-gas mixture can be enhanced by a pumping action.

The filling of an insulating glass pane 10 with filler gas by means of the apparatus of this invention can also be performed as described hereinbelow.

The filler gas is introduced into the interior of the insulating glass pane 10 preferably via an obliquely upwardly oriented nozzle through the connection 50 and the sealing device 30. Air and/or air-gas mixture exits over the entire height of the gap at the vertical rim of the insulating glass pane 10 that is at the rear as seen in the conveying direction (arrow 25), between the glass sheet adjacent to the movable plate 2 and the spacer frame attached to the other glass sheet adjacent to the fixed plate 1. Air or air-gas mixture enters the channel formed on one side by the gasket 36 of the sealing device 31 and on the other side by the rim of the insulating glass pane 10 (over the entire height of this channel which substantially corresponds to the height of the insulating glass pane 10), and flows out of this channel in the upward direction. The aforementioned channel is thus formed of the space between the gasket 36, on the one hand, and of the rearward, vertical edge joint of the insulating glass pane 10 which is still open toward the interior of the insulating glass pane 10.

This mode of operation is of special advantage since, on account of the large exit cross section, the flow velocity with which air and/or air-gas mixture leaves the interior of the insulating glass pane 10 is slow so that turbulences and nozzle effects impairing an orderly filling step are reduced and, respectively, avoided.

If desired, it is possible in the disclosed mode of operation to collect air or air-gas mixture exiting via the channel by means of an exhaust device associated with the upper end of the above-mentioned channel, and to pass such air or air-gas mixture on to waste disposal or to process same to recover filler gas for use in a further gas exchange.

It is understood that, in the afore-described technique, the connections 51, 52, 53 for exhausting air and/or air-gas mixture are unnecessary during the filling of the insulating glass pane 10 with filler gas. Also, in this operating technique, no transverse webs of the aforementioned type are provided in the gasket 36 of the sealing device 31 between the sealing lips 37 and 38.

In the described mode of operation, it is not disadvantageous to omit transverse webs also in the gasket 36 of the sealing device 30, so that filler gas can enter the interior of the insulating glass pane 10 also via the channel formed in the zone of the sealing device 31 by its gasket 36 and the adjoining rim of the insulating glass pane 10, or air or air-gas mixture can exit and flow away—presupposing that a corresponding nozzle (see below) is present. The above notwithstanding, it is preferred that the gasket 36 of the sealing device 30 exhibit the aforementioned webs in the justdescribed operating technique, at least impeding an efflux of air or air-gas mixture in the zone of the rim of the insulating glass pane 10 that is at the front as seen in the conveying direction (arrow 25).

If the filling step is executed, as described hereinabove, without providing special connections 51, 52 or 53 for the removal of air or air-gas mixture, i.e. the air or air-gas mixture is exhausted through the channel in the zone of the sealing device 31, then it is recommended to provide a nozzle projecting into the interior of the insulating glass pane 10 in the region of the connection 50 for feeding filler gas into the interior of the insulating glass pane 10; the orifice of this nozzle is flared (slow efflux velocity), and is preferably oriented obliquely upwardly.

As soon as the desired degree of filling (for sound protection about 50%, for full thermal protection at least 90% filler gas in the interior of the insulating glass pane 10) has been attained in the interior of the insulating glass pane, the feeding of filler gas is interrupted, and the insulating glass pane 10 is press-bonded preferably while still in the apparatus, after the two sealing devices 30, 31 have been removed from the interspace 8 between the plates 1 and 2. In case the sealing devices 30 and 31 are designed to be so narrow that they are narrower than the insulating glass pane 10 to be produced, or in case they are elastically compressible (FIG. 7), they can also remain within the space 8 of the apparatus while the insulating glass pane 10 is pressed by having the plate 2 approach the plate 1. Upon the approach of plate 2 to plate 1, the glass sheet of the insulating glass pane 10 proximate to the plate 2 is initially brought into contact in its entirety with the spacer frame. In order to facilitate this movement, the plate 2 can be equipped with vacuum devices to retain the glass sheet against the plate 2 (for example suction cups, or the plate 2 is provided with apertures to which a vacuum can be applied) and can be designed to be slightly liftable (e.g. 0.5 mm) to prevent the bottom rim of the glass sheet from scraping transversely over the conveyor belt 9. Eccentric cams can be provided, for example, in order to lift the plate 2; these cams are associated with the lower rim of the plate 2.

Then the plate 2 is again moved away from the plate 1, and the finished press-bonded insulating glass pane 10 filled with filler gas can be carried out of the apparatus and transported, for example, to a caulking facility.

In summation, the invention can be portrayed, for example, as follows:

An apparatus for filling insulating glass panes 10 with filler gas comprises two plates 1 and 2 and an endless conveyor belt 9 provided at the lower rim of the plates 1 and 2, on which the insulating glass pane 10 stands with its lower, open rim. Sealing devices 30 and 31 that can be brought into contact with the vertical rims of the insulating glass pane 10 are provided between the plates 1 and 2 in order to seal the interior of the insulating glass pane 10. The sealing device 30 is associated with a connection 50 for feeding filler gas into the interior of the insulating glass pane 10. Air and, respectively, air-gas mixture can be removed from the insulating glass pane 10 via a channel formed by the other vertical rim of the insulating glass pane 10 and a sealing device 31 applied at that location, wherein air or air-gas mixture can flow out over the entire height of the open, vertical rim of the insulating glass pane 10 from the interior of the latter.

What is claimed is:

1. A process for filling insulating glass panes with a filler gas, each of said glass panes comprising first and second glass sheets with a spacer frame therebetween, the process comprising arranging an insulating glass pane upright on a lower edge thereof with a said spacer frame contacting a first of said glass sheets entirely about a periphery of said first sheet and a second of said glass sheets contacting said spacer frame only along an upper edge of said second sheet with a lower edge of said second sheet spaced a distance from said spacer frame, sealing said lower edge of said pane and opposite vertical edges of said pane, introducing filler gas into an interior of said pane through a space between said spacer frame and said second sheet at one vertical edge of said pane and withdrawing gas from the interior of said pane between said spacer frame and said second sheet at the other vertical edge of said pane, and thereafter pressing said second sheet into contact with said spacer frame entirely about the periphery of said second sheet.

2. A process according to claim 1, wherein said filler gas is introduced into a lower corner of said pane in an obliquely upward direction.

3. A process according to claim 1, wherein said lower edge of said pane is sealed by resting the pane upright on a conveyor which closes said lower edge of said pane.

* * * * *